US006619186B2

(12) United States Patent
Duquette et al.

(10) Patent No.: US 6,619,186 B2
(45) Date of Patent: Sep. 16, 2003

(54) SERVO CONTROLLED TIMING ADVANCE FOR UNIT PUMP OR UNIT INJECTOR

(75) Inventors: Mark Duquette, Andover, CT (US); Kenneth Klopfer, East Hartland, CT (US)

(73) Assignee: Stanadyne Corporation, Windsor, CT (US)

( * ) Notice: Subject to any disclaimer, the term of this patent is extended or adjusted under 35 U.S.C. 154(b) by 1 day.

(21) Appl. No.: 09/992,943

(22) Filed: Nov. 6, 2001

(65) Prior Publication Data

US 2002/0053282 A1 May 9, 2002

Related U.S. Application Data

(60) Provisional application No. 60/247,825, filed on Nov. 9, 2000.

(51) Int. Cl.[7] ..... F01B 31/14

(52) U.S. Cl. ..... 92/60.5; 92/12.1; 123/502; 417/274

(58) Field of Search ..... 92/60.5, 12.1; 123/501, 502; 417/218, 274, 499, 470

(56) References Cited

U.S. PATENT DOCUMENTS 4,494,514 A * 1/1985 Augustin ..... 123/502
5,193,510 A * 3/1993 Straubel ..... 123/502
6,406,269 B1 * 6/2002 Dingle et al. ..... 92/60.5

* cited by examiner

*Primary Examiner*—Edward K. Look
*Assistant Examiner*—Michael Leslie
(74) *Attorney, Agent, or Firm*—Alix, Yale & Ristas, LLP

(57) ABSTRACT

A hydraulically actuated servo piston and hydraulic advance piston are integrated into the cam follower of a unit pump or injector to provide variable advance for an injection event produced by the pump or injector. The servo piston is nested in the advance piston with fluid passageways in the advance piston selectively opened or closed by movement of the servo piston. The full pressure of a hydraulic pump is available to the advance piston for powering the advance function, while stepwise reduced levels of hydraulic pressure from the same hydraulic pump are applied to control movement of the servo piston. A damping orifice restricts flow of hydraulic fluid to and from the servo piston.

19 Claims, 11 Drawing Sheets

SERVO CONTROLLED TIMING ADVANCE FOR UNIT PUMP OR UNIT INJECTOR

CROSS REFERENCE TO RELATED APPLICATIONS

This application claims the benefit of U.S. Provisional Application No. 60/247,825, filed Nov. 9, 2000.

BACKGROUND OF THE INVENTION

1. Field of the Invention

The present invention relates to timing advance for fuel injection systems of the type typically used in vehicle engines. In particular, the present invention is an improvement on the hydraulically actuated timing advance technique described in U.S. patent application Ser. No. 09/638,758 filed on Aug. 14, 2000 for "Timing Advance Piston for Unit Pump or Unit Injector and Method Therefor", the disclosure of which is hereby incorporated by reference.

2. Description of the Related Art

The automotive industry is under constant pressure to reduce undesirable emissions from the internal combustion engines that power almost all vehicles currently used throughout the world. It is well known that engine emissions can be improved by adjusting the so-called "timing" of the fuel injection event relative to the position of the engine piston in its engine cylinder under various engine operating conditions.

SUMMARY OF THE INVENTION

The invention is directed to a system and method by which a hydraulically actuated advance piston in a unit pump or unit injector is further modulated by a servo device. A servo device is integrated with an advance piston in the unit pump or unit injector. More particularly, an advance piston and a servo piston are nested within the cam follower of a unit pump or unit injector.

In accordance with one aspect of the present invention, a first hydraulic chamber (hereinafter the advance chamber) is defined between the advance piston and the cam follower body. A second hydraulic chamber (hereinafter the servo chamber) is defined between the servo piston and the advance piston. A relatively high, substantially constant hydraulic pressure is continuously available to the advance chamber through ports and passageways that depend on the position of the servo piston within the advance piston. The lubrication pump of an internal combustion engine may for example, generate this constant hydraulic pressure. The position of the servo piston within the advance piston is dependent upon a modulated hydraulic pressure applied to the servo chamber. Movement of the advance piston relative to the cam follower is adjusted opening and closing hydraulic ports, e.g., moving the servo piston relative to the advance piston to apply hydraulic pressure to or bleed hydraulic fluid from the advance chamber.

Preferably, the hydraulic pressure applied to the servo piston is derived from the same hydraulic source as the constant hydraulic pressure. In accordance with a particular aspect of the invention, the full hydraulic pressure produced by, e.g. an engine lubrication pump is applied to the advance piston while reduced levels of pressure from the same source are used to control application of the full hydraulic pressure to the advance piston. The full hydraulic pressure is preferably modulated in discrete increments and applied to the servo chamber to alter the position of the servo piston within the advance piston. For example, if the full hydraulic pressure available to the advance piston is 40 psi, the modulated pressure applied to the servo chamber can be any set of discrete pressures between 0 and 40 psi. A preferred embodiment of this invention will be described herein with reference to four discrete pressure levels between 0 and 40 psi, e.g., 5, 15, 25 and 35 psi. By no means is the invention limited to any particular number or values of discrete pressure levels.

In accordance with another aspect of the present invention, the fluid input port to the servo chamber is configured as a damping orifice or restricted flow opening. This damping orifice restricts the rapidity with which the servo piston can move by restricting the flow of fluid into and out of the servo chamber. The servo piston may, in the harsh environment of a cam actuated follower, have an undesirable tendency to move relative to the advance piston in response to accelerations imposed upon the cam follower by the cam, rather than the deliberate application of control pressure. A damping orifice at the entrance to the servo chamber slows movement of the servo piston relative to the advance piston, so that such relative movement takes place over several cam rotations.

One or more springs are arranged to impose a known force against the servo piston in opposition to the direction of hydraulic actuation. The spring provides a reliable means for imposing a known force on the servo piston, which is opposed by the modulated pressure delivered to the servo chamber. A differential between the servo spring force and the pressure in the servo chamber determines the position of the servo piston within the advance piston bore. By connecting the advance chamber to hydraulic pressure (advance) or alternatively to a bleed passage (retard), the servo piston position determines the volume of the advance chamber and, ultimately, the position of the advance piston relative to the cam follower.

The discrete modulation of the hydraulic pressure to the servo piston is preferably translated into discrete and predictable advance piston positions by the use of hydraulic porting and passageway configurations that open and close precisely in response to displacement of the advance piston relative to one or both of the follower body and servo piston. Use of porting with edges acting as valves achieves more precise control of multiple discrete advance positions than is available from reliance solely on hydraulic pressure modulation from, e.g., a proportional solenoid valve.

The net force acting on the advance piston is proportional to the difference between the pressure in the advance chamber and the pressure in the servo chamber (which is proportional to the force exerted by the servo spring on the servo piston). As the advance chamber decreases or increases in volume, the advance piston is displaced toward or away from the pumping plunger, thereby affecting the return or rest position of the plunger and thus the timing of an injection event.

The integration of the advance piston, servo piston, servo spring, and associated porting and passageways into the follower body to form a compact cam follower assembly, represents another aspect of the invention. This integration is facilitated by incorporation of an advance piston cap resting on a shoulder formed near the upper end of the advance piston. The servo spring seat is in the form of a generally cylindrical body coaxially received within the cap and the servo piston. The cap and the advance piston are shaped to generously accommodate a transversely oriented holding pin anchored in the follower body and closely penetrating the servo spring seat. The spring seat is thereby fixed in relation to the follower body, but the advance piston and associated cap can move relative to the follower body and pin. The integration is further implemented by hydraulic ports and passageways penetrating the cylindrical wall of the follower body, selectively alignable with ports and passageways through the cylindrical wall of the advance piston, which in turn are selectively alignable with annular fluid transfer channels on the outer surface of the servo piston.

An object of the present invention is to provide a new and improved servo controlled advance piston for a unit pump or injector that provides a greater degree of control over the timing of an injection event.

Another object of the present invention is to provide a new and improved servo controlled advance piston for a unit pump or injector that improves the performance of an internal combustion engine equipped with the servo controlled advance piston for a unit pump or injector.

A further object of the present invention is to provide a new and improved servo controlled advance piston for a unit pump or injector that reduces undesirable exhaust emissions from an internal combustion engine equipped with the servo controlled advance piston for a unit pump or injector.

A yet further object of the present invention is to provide a new and improved servo controlled advance piston for a unit pump or injector that integrates control of injection duration with control of injection timing.

These and other objects, features, and advantages of the invention will become readily apparent to those skilled in the art upon reading the description of the preferred embodiments, in conjunction with the accompanying drawings.

BRIEF DESCRIPTION OF THE DRAWINGS

An illustrative example of the invention is described below with reference to the accompanying drawings, in which.

DESCRIPTION OF THE PREFERRED EMBODIMENTS

Figure 1A:
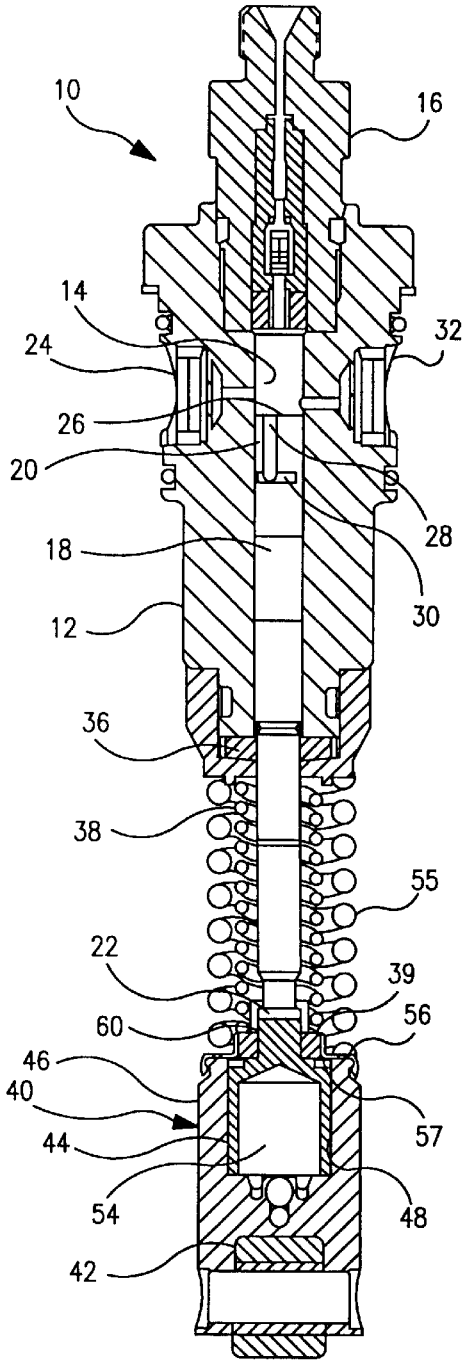
FIGS. 1A and 1B are sectional views, taken from the front and side respectively, of a unit pump for a fuel injector nozzle, substantially as described in one embodiment of said pending U.S. patent application Ser. No. 09/638,758, where the advance piston in the cam follower is hydraulically controlled, but without the improvement of the present invention.
Figure 1B:
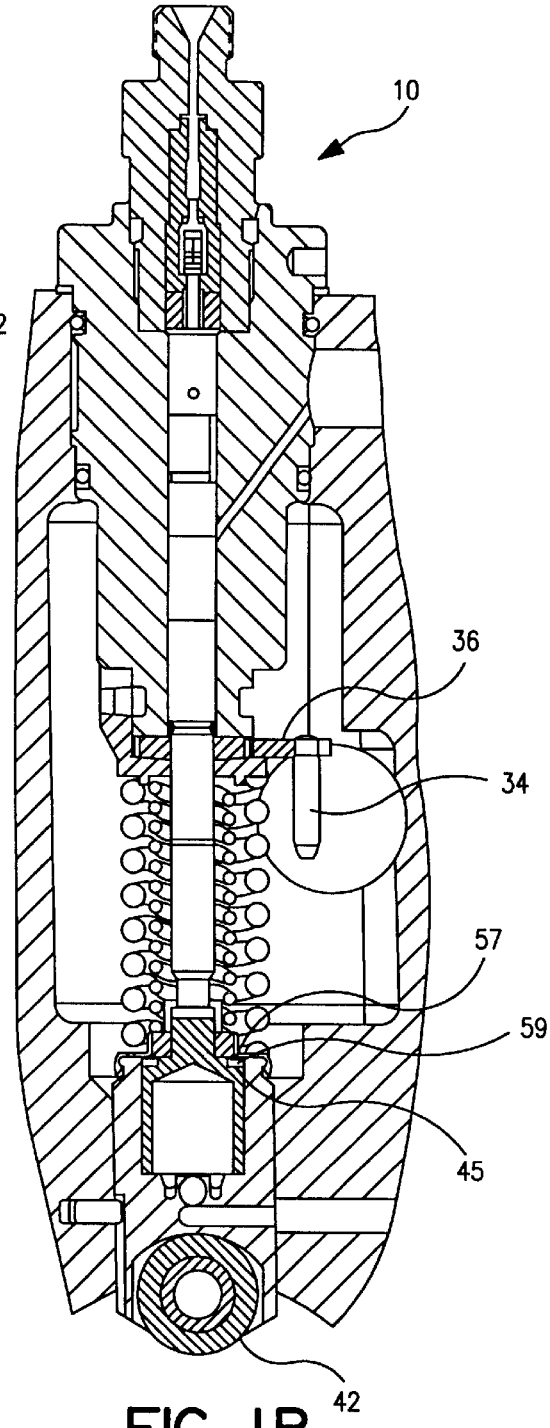

FIGS. 1A and 1B illustrate a fuel injection unit pump 10 or unit injector that can be improved by the present invention. The unit pump 10 comprises a body 12 defining a longitudinal pumping bore 14, with a head 16 mounted at one end of the body coaxially with the bore. A generally cylindrical pumping plunger 18 is disposed within the pumping bore 14 for reciprocal motion therein. The pumping plunger 18 has a pumping end 20 disposed toward the head 16 and an opposed driven end 22 projecting from the unit pump body 12. A fill/spill port 24 is provided in the body 12 and movement of a leading edge 26 of the plunger pumping end 20 past the fill/spill port defines the beginning of an injection event. Upper and lower channel portions 28, 30 partially surround the outside diameter of the pumping plunger 18. Alignment of lower channel portion 30 with fill/spill port 24 serves to define the end of the fuel injection event. Fuel supply port 32 is in fluid communication with the fill/spill port 24.

Also shown is a control pin 34 mounted to a control arm 36 for rotation of the pumping plunger 18 within the pumping bore 14. Rotation of the pumping plunger 18 changes alignment of the channels 28, 30 in relation to the fill/spill port 24 and thereby the injection duration and thus the quantity of the fuel injected. The driven end 22 of the pumping plunger is mounted to a spring seat 39. A coiled plunger return spring 38 is trapped between the unit pump body 12 and the plunger spring seat 39 and functions to bias the pumping plunger 18 away from the head 16. A cam follower assembly 40 is disposed between the driven end 22 of pumping plunger 18 and a cam roller 42. In a usual manner, the cam follower assembly 40 acts to translate rotation of a cam (not illustrated) into reciprocating linear motion and transmit that reciprocating linear motion to the pumping plunger 18.

An inverted cup shaped advance piston 44 is mounted within a bore 48 in the cam follower body 46. An advance chamber 54 defined beneath the advance piston 44 can be pressurized via a hydraulic circuit, thereby displacing the advance piston 44 away from the cam roller 42 a distance which may range to about 3 millimeters. The pumping plunger driven end 22 abuts the advance piston 44, so that displacement of the advance piston away from the cam follower assembly 40 similarly displaces the pumping plunger 18 away from the cam follower and cam rotational axis. The advance piston 44 may also comprise an aperture for providing for the escape of any air caught within the advance piston.

A follower spring seat 56 includes an inwardly projecting shoulder 57 that is fixed relative to the follower body 46 but permits axial movement of the plunger return spring seat 39 relative to the follower body 46. A cam follower spring 55 is captured between the unit pump body 12 and the follower spring seat 56. The plunger return spring 38 has a relatively low spring force of about 5 pounds and spring rate of about 75 pounds. The plunger spring seat 39 engages the advance piston 44 but does not contact the cam follower body 46. The follower return spring 55 surrounds the plunger return spring seat 39 and is trapped between the unit pump body 12 and the follower spring seat 56. The cam follower spring 55 has a high spring force of about 30 pounds of force and a spring rate of about 200 pounds to maintain the cam follower assembly in continuous contact with the cam.

The follower spring seat 56 includes an inward, downward-facing circumferential shoulder 57. When the advance piston 44 is in the retracted position, an advance piston circumferential shoulder 45 is axially separated from the follower spring seat shoulder 57, shown as gap 59 (FIG. 1B). As a hydraulic advance circuit pressurizes fluid in the advance chamber 54, the advance piston 44 is displaced away from the cam follower and the gap 59 closes as advance piston shoulder 45 approaches the follower spring seat shoulder 57. At the advance piston maximum displacement, the piston shoulder 45 contacts the annular shoulder 57, preventing further relative movement of the advance piston 44. The depth dimension of the gap 59 defines the maximum possible advance piston displacement and thereby the advance authority.

The follower spring 55 imposes high forces to maintain continuous contact between the cam follower assembly 40 and the cam. In spite of the use of a high force follower spring 55, the advance piston 44 is opposed by only the lower force plunger return spring 38 until the advance piston has reached its maximum displacement. The use of nested follower spring 55 and plunger return spring 38 allows the advance piston 44 to be actuated by relatively low pressure hydraulic supply, such as, for example, lubrication oil from the internal combustion engine pressurized lubrication system (typically 40–100 psi).

Figure 2:
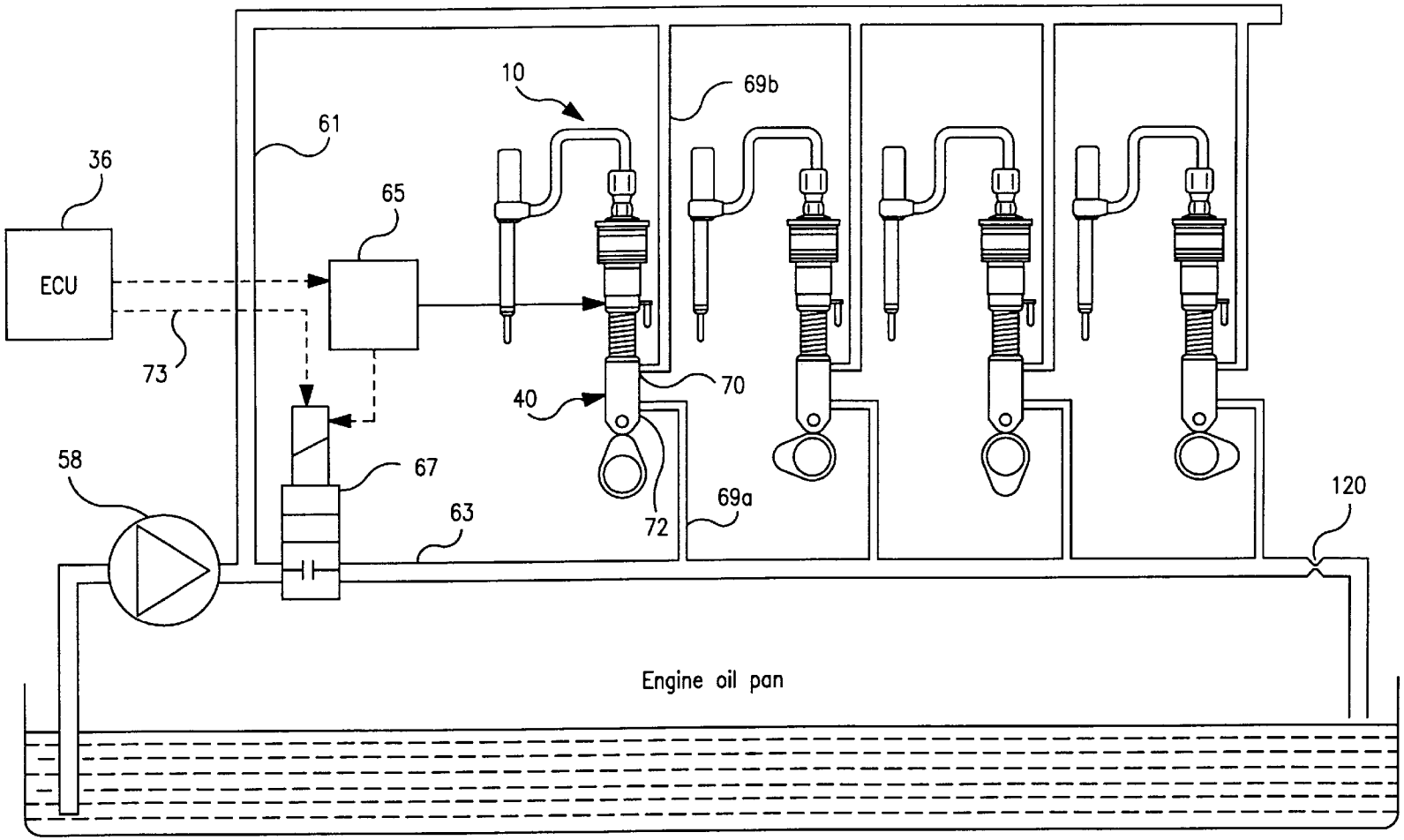
FIG. 2 is a schematic of the control system according to the present invention, which can be implemented, for example, as an improvement to the advance technique associated with FIG. 1.
Figure 3A:
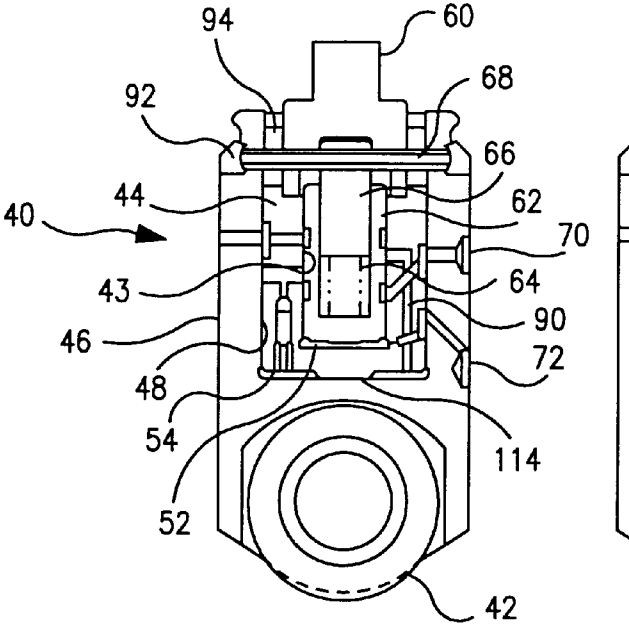
FIGS. 3A–3D show the preferred embodiment of the follower assembly incorporating a nested advance piston and servo piston with independent hydraulic supply, (with the hydraulic passages shown in a single plane for clarity)
Figure 3B:
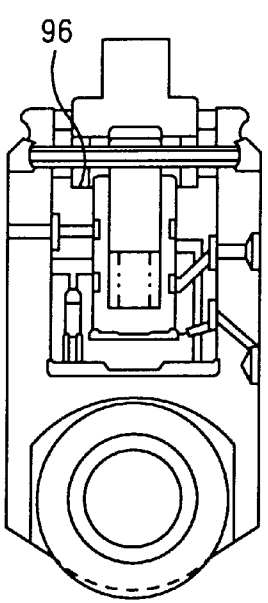
Figure 3C:
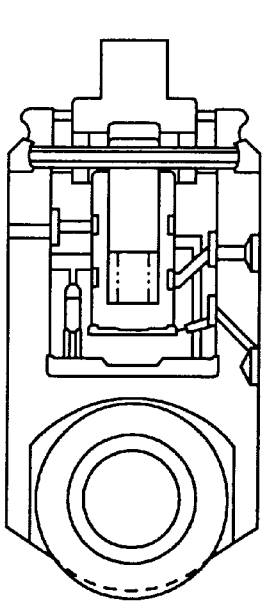
Figure 3D:
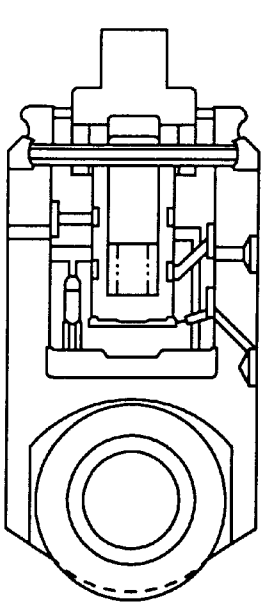
Figure 4:
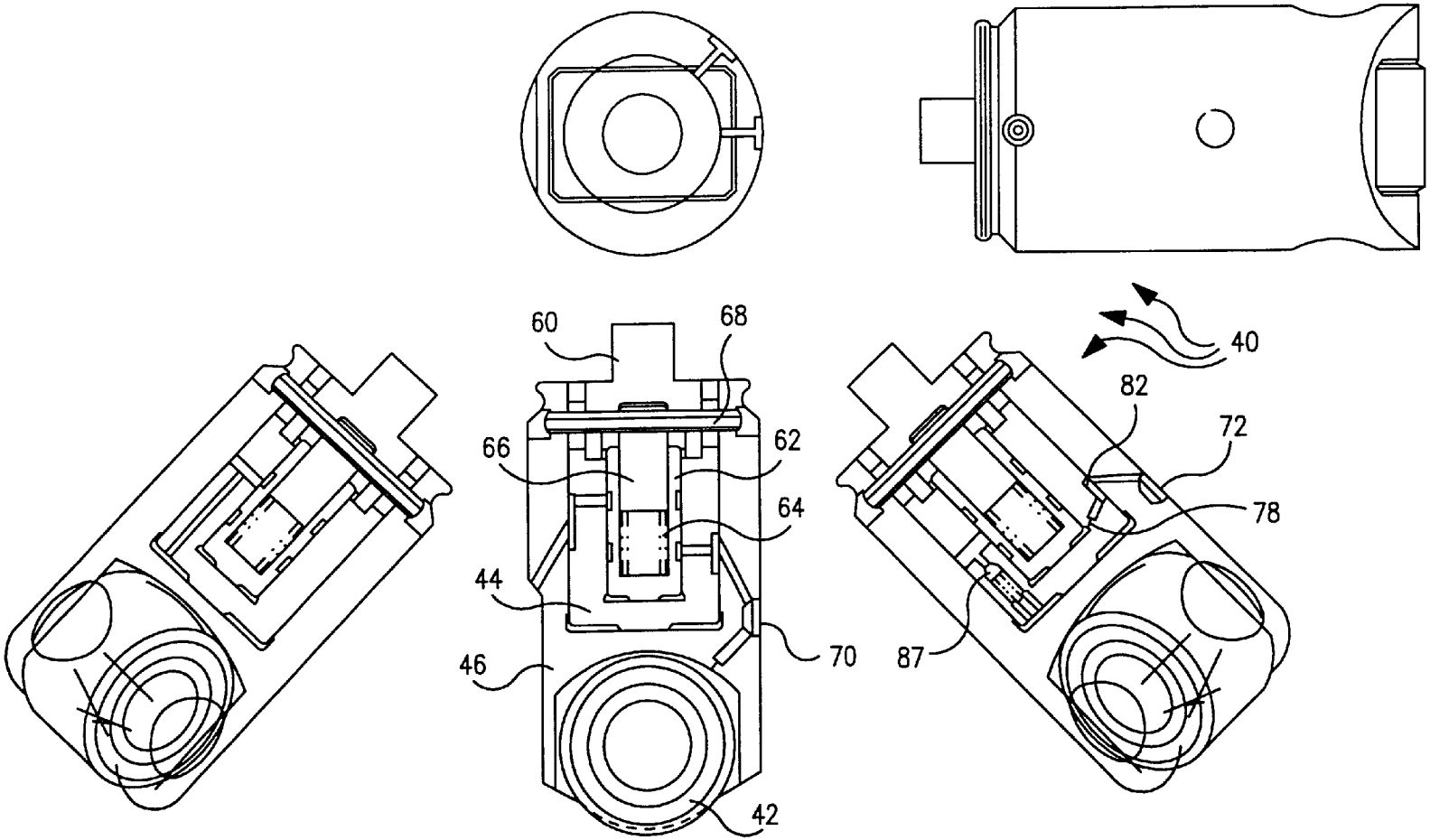
FIG. 4 illustrates the follower assembly with integral timing advance according to the embodiment shown in FIGS. 3A–3D in four angular orientations relative to an end view, three of the views are partly in section.
Figure 5F:
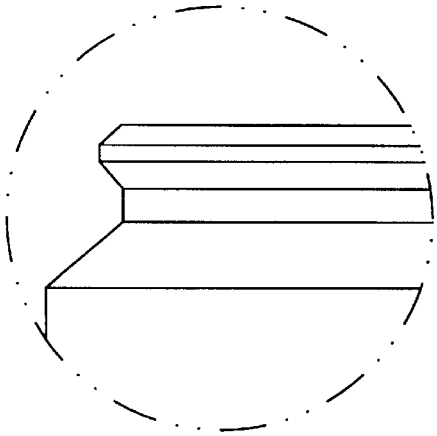
FIGS. 5A–5F include six views of the cam follower and one detail view (FIG. 5F) of the upper end of the follower, according to the embodiment shown in FIG. 4.
Figure 5C:
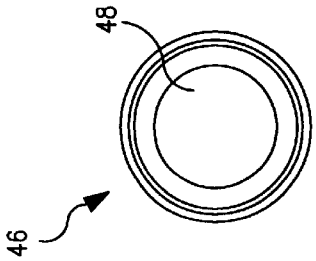
Figure 5E:
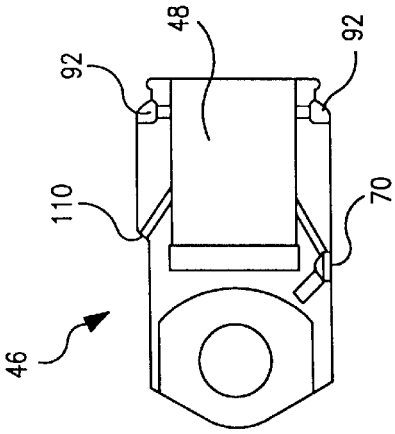
Figure 5A:
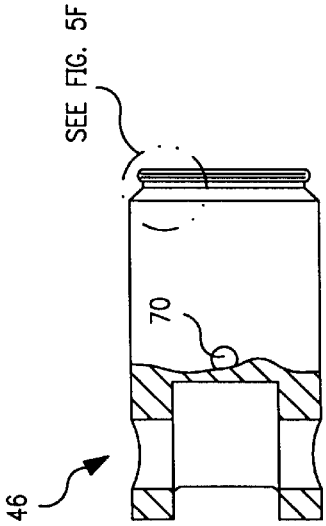
Figure 5D:
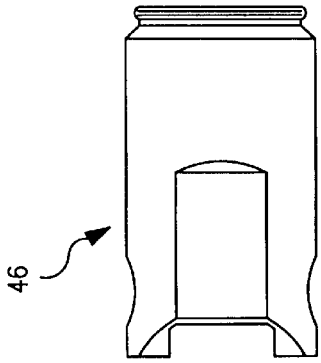
Figure 5B:
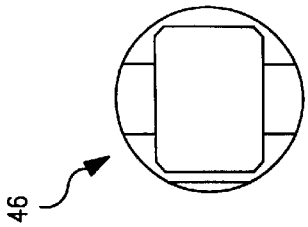
Figure 6A:
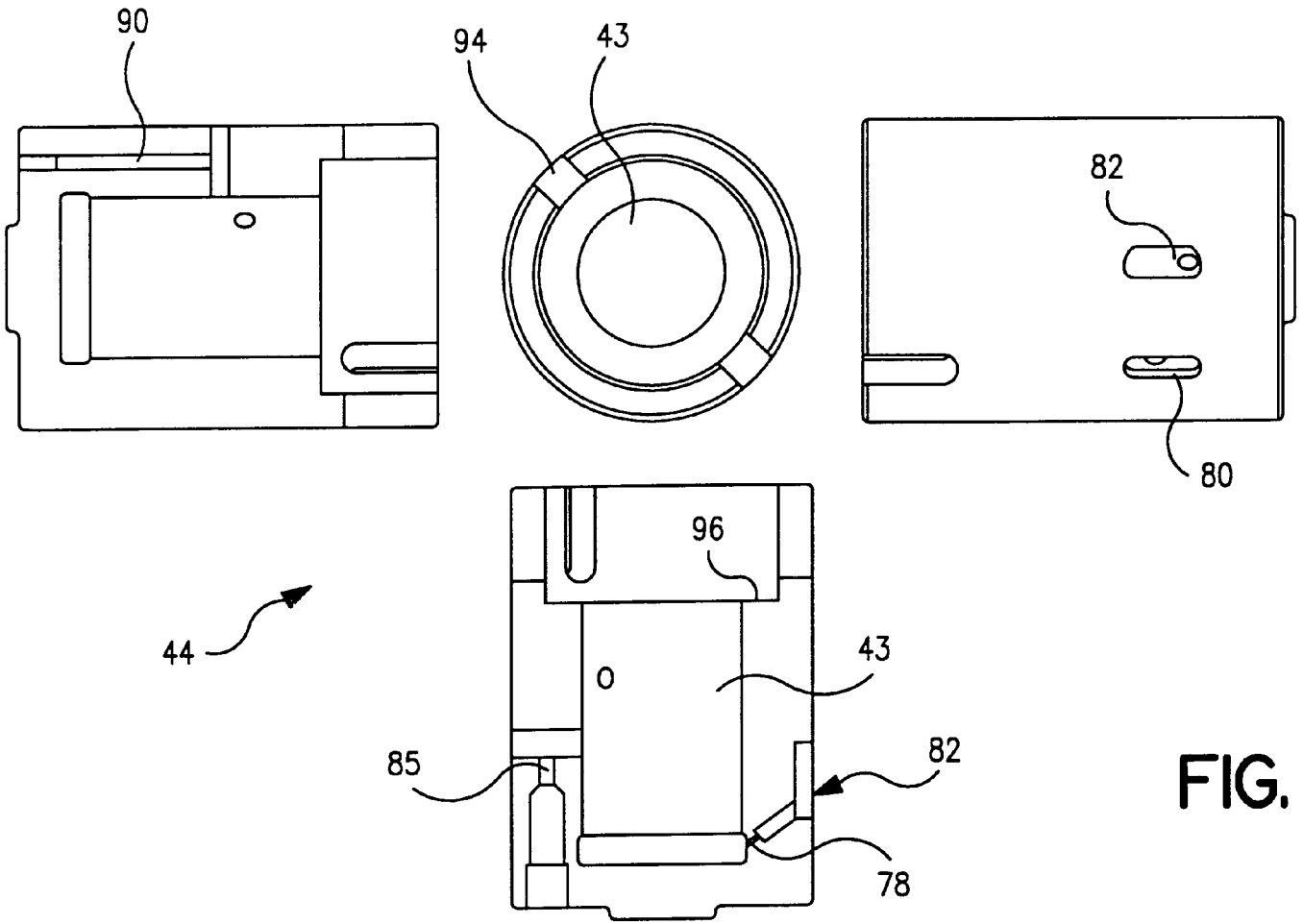
FIG. 6A illustrates the advance piston according to the embodiment shown in FIG. 4 in three angular orientations relative to an end view, two of the views being sectional views.
Figure 6B:
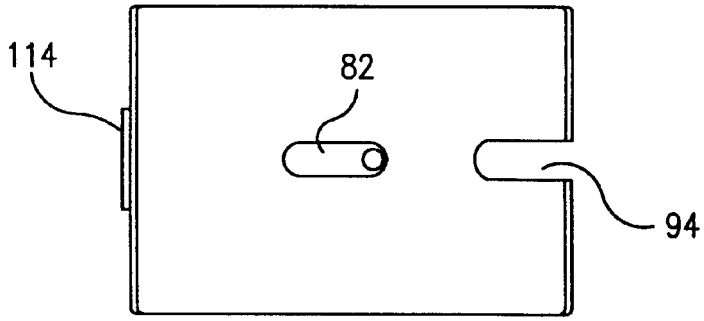
FIGS. 6B–6D are two exterior views and one sectional view of the advance piston according to the embodiment shown in FIG. 4, with FIGS. 6B and 6D being opposite exterior side views.
Figure 6C:
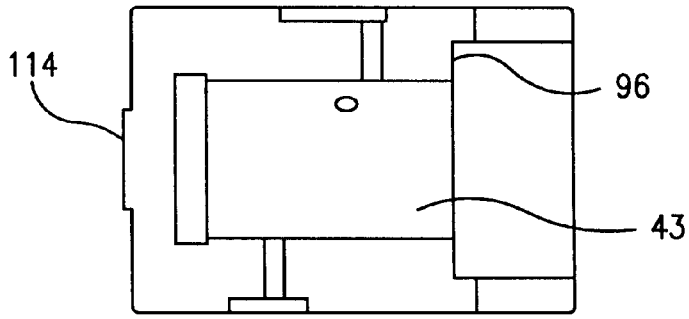
Figure 6D:
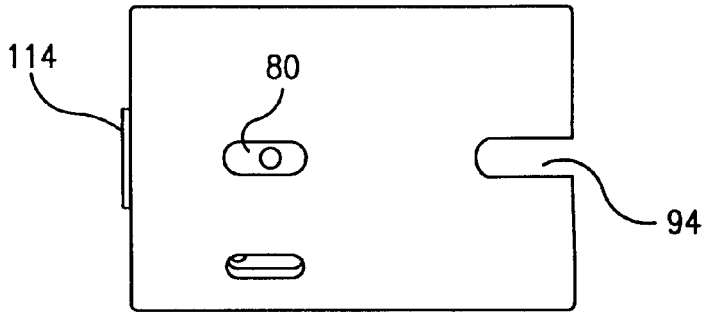
Figure 7B:
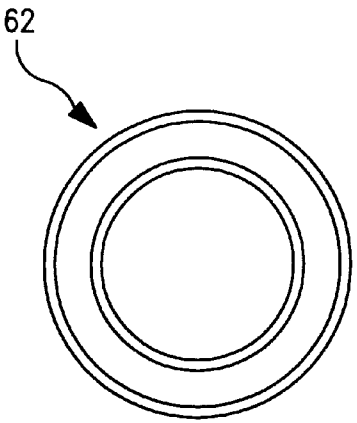
FIGS. 7A and 7B are side sectional and end views, respectively, of the servo piston according to the embodiment shown in FIG. 4.
Figure 7A:
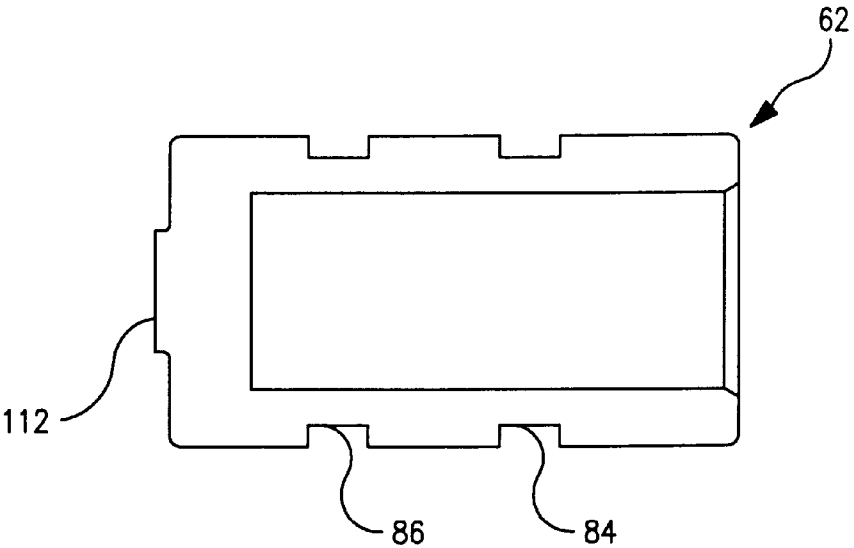
Figure 8C:
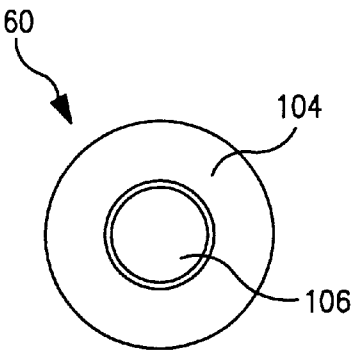
FIGS. 8A–8D are four views of the advance piston cap according to the embodiment shown in FIG. 4.
Figure 8D:
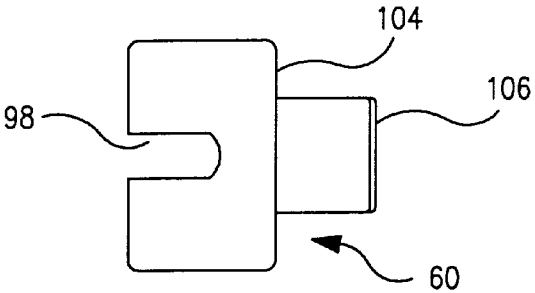
Figure 8A:
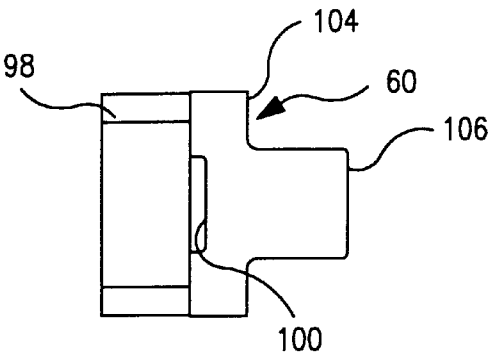
Figure 8B:
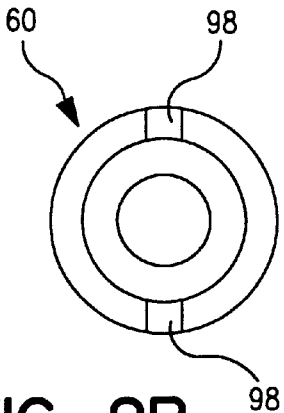
Figure 9B:
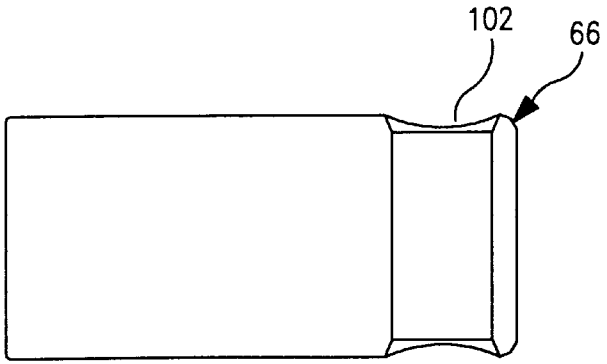
FIGS. 9A–9C are side exterior, side sectional and end views of the servo spring seat or stop according to the embodiment shown in FIG. 4.
Figure 9A:
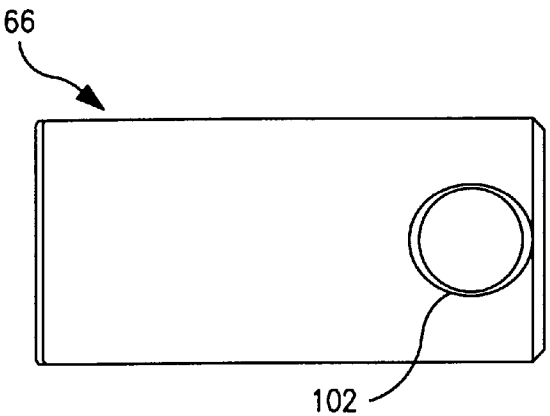
Figure 9C:
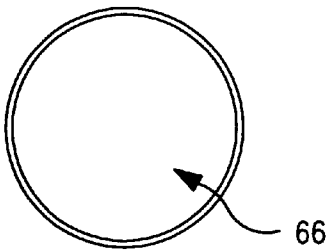

With reference to FIGS. 2 through 10B, positional control of a hydraulically actuated advance piston as shown in FIG. 1, is improved by the use of two hydraulic circuits and associated porting of a servo piston relative to an advance piston, and of the advance piston relative to the cam follower body. The hydraulic circuits are shown in FIG. 2. The main source of motive power for the advance functionality is provided by an auxiliary line 61 from the main oil lube pump 58, which maintains a relatively steady hydraulic pressure of, e.g., 40 psi. A servo control hydraulic circuit 63 is preferably also auxiliary to the main oil lube pump 58. Modulation of the pressure in the control hydraulic circuit 63 between 5–35 psi, provides modulation of the servo piston 62 within each cam follower, which in turn determines the position of the advance piston 44 relative to the follower body 46 by connecting and disconnecting fluid passageways communicating with the advance chamber 54 to alternatively inject or bleed hydraulic fluid therefrom. The porting system provides discrete positional control of the advance piston 44 relative to the cam follower body 46 as will be further explained below.

Preferably, injection event duration control is provided by a programmable electronically positioned rack 65 connected to the control arm/control pin 34 of each pumping plunger 18. This can be implemented with a so-called "smart actuator," such as the Woodward LCS Series engine speed controller available from Woodward Automotive Products, Oak Ridge, Tenn. The main hydraulic circuit 61 for powering the advance piston does not require active control. The servo control circuit 63 preferably includes an active device 67 capable of providing stepwise variable control pressure. One example of such an active device is a proportional pressure-reducing valve available from Thomas Magnete of San Fernando 35, Herdorf, Germany. In the proportional pressure reducing valve, a valve is integrated into the solenoid so that the valve tube and the magnetic pole form a single unit within the solenoid housing. The pressure to be controlled opposes magnetic force generated by the solenoid coil. There is a proportional relationship between the current applied to the solenoid and the pressure to be controlled. Sufficient current applied to the solenoid armature moves the valve spool and clears an oil feed aperture to the consuming device, in this case the servo control circuit 63. Other means for providing stepwise variable control pressure are readily available.

Whereas the main hydraulic circuit 61 can deliver a constant pressure to all the unit injectors 10 simultaneously via respective inlet lines 69*b* and associated ports 70, the control circuit 63 can take either of at least two forms. As shown in FIG. 2, a single proportional solenoid valve 67 can deliver its modulated output pressure to all the control inlet lines 69*a* and associated control inlet ports 72. Alternatively, one proportional solenoid valve can be provided for each unit injector 10, thereby permitting individualized timing adjustment.

The input signal 73 for the proportional valve 67 of the control circuit 63, can simply be an open loop, or a beginning of injection (BOI) signal from the ECU 36 using pressure from, e.g., the no leak-off cap, to close the loop on timing. Alternatively, the smart controller for the electronically positioned rack 65 can control solenoid 67 as well as control arm 34.

FIGS. 3A–9C illustrate a preferred cam follower assembly 40, or tappet assembly, for implementing the present invention. The follower body 46 has a follower bore 48 that opens toward the pumping plunger, e.g., away from the cam roller 42. The advance piston 44 is situated within the follower bore 48 for axial movement therein. This defines a variable volume advance chamber 54 at the external base of the advance piston 44. The advance piston 44 has an axial bore 43 that opens toward the pumping plunger for receiving the servo piston 62. The base of the servo piston 62 and a portion of the advance piston bore 43 define a variable volume servo chamber 52 between the servo piston 62 and the advance piston 44.

The servo piston 62 opens toward the pumping plunger for receiving a servo spring 64 which at one end bears against the internal bottom of the servo piston, and at the other end bears against a seat or stop 66. The stop 66 is preferably axially elongated, with a hole, notch or similar profile 102 to receive a holding pin 68 or the like, which is insertable through diametrically opposed holes 92 in the upper wall of the follower body 46. This immobilizes the seated end of the servo spring 64 and thus assures the spring imposes a known force vs. length relationship against the servo piston 62 opposed to the force of hydraulic actuation. The upper end of the advance piston 44 has a yoked or similar profile 94, to provide a channel for avoiding interference with the holding pin 68 as the advance piston 44 moves upwardly relative to the follower body 46. The depth of yoke 94 defines the limit of advance piston 44 movement away from the cam roller 42, otherwise referred to as the advance authority.

An internal shoulder 96 or shelf on the advance piston 44 provides a bearing surface for the lower portion of a piston cap 60. The lower portion of the cap 60 is yoked 98 so that it can move axially with the advance piston 44 relative to the follower body 46 without obstruction by the holding pin 68. The upper end of the cap 60 has an external ledge or shoulder 104 and a central projection 106 for engaging the driven end of a pumping plunger. The cap 60 thus provides the same functionality for bearing on the pumping plunger and supporting the plunger return spring 55, as does the corresponding structure formed on the unitary advance piston shown in FIG. 1. In particular, with the clips 56,58 or the like securable to the upper end of the follower body 46 to act as a seat for the follower return spring, similar to that shown in FIGS. 1A and 1B, it is evident that the actuation and return of the pumping plunger is separate from the actuation and return of the follower body.

It can thus be appreciated that an actuation length of the cam follower 40, e.g., the distance between cam roller 42 and central projection 106, depends upon the volume of the advance chamber 54. Injecting hydraulic fluid into the advance chamber while blocking exit of hydraulic fluid from the advance chamber increases its volume and displaces (advances) the advance piston 44 away from the cam roller 42. Bleeding hydraulic fluid from the advance chamber 54 while blocking injection of hydraulic fluid into the advance chamber decreases its volume which moves (retards) the advance piston toward the cam roller 42. The position of the servo piston 62 inside the advance piston 44 controls the volume of the advance chamber by alternatively opening and closing the injection and bleed passages.

There are three basic positions of the servo piston 62 relative to the advance piston 44. A first position, best illustrated in FIG. 10A, ports full pressure hydraulic fluid to the advance chamber 54 via the power inlet port 70, upper transfer port 80, lower transfer annulus 86 and feed passage 85 (including check valve 87) while blocking bleed from the advance chamber. A second neutral position, best illustrated in FIGS. 3A–3D, blocks both injection into and bleed from the advance chamber 54. A third position, best illustrated in FIG. 10B, blocks injection while permitting bleed of hydraulic fluid from the advance chamber via bleed passage 90, upper transfer annulus 84, bleed port 88 and bleed passage 110.

The operation of the follower assembly 40 will be described in greater detail with reference to FIGS. 3A–3D, 10A and 10B. At all times, the full hydraulic pressure of the engine lube pump, e.g., 40 psi is available to the advance chamber 54. Hydraulic fluid is delivered to the advance chamber through the power inlet port 70 on the wall of the follower body 46, upper transfer port 80 and passage in the wall of the advance piston 44, lower transfer annulus 86 on the wall of the servo piston and feed passage 85 in the advance piston. Fluid input to the advance chamber 54 can take place only when the lower transfer annulus 86 and the feed passage 85 are aligned. Feed passage 85 includes check valve 87 to ensure a hydraulic lock in the advance chamber when the cam follower is under a pumping load. In the illustrated embodiment, a stepwise variable control pressure of, e.g., 5, 15, 25, and 35 psi is provided at the control inlet port 72 in the wall of the follower body, for fluid communication through lower port 82 and passage in the advance piston 44 (preferably including a damping orifice 78), for discharge into the servo chamber 52.

A cam follower actuated by an engine-driven cam experiences many hundreds of very rapid accelerations caused by rapid changes of direction. Internal components of such cam followers have a tendency to move in response to the forces of acceleration rather than in a controlled manner. In the integrated servo controlled advance assembly, the position of the control component (servo piston) relative to the advance piston is critical. The damping orifice 78 restricts the flow of hydraulic fluid into and out of the servo chamber 52. This restricted flow damps movement of the servo piston relative to the advance piston 44. Thus, movement of the servo piston 62 due to acceleration induced forces is minimized.

Figure 10B:
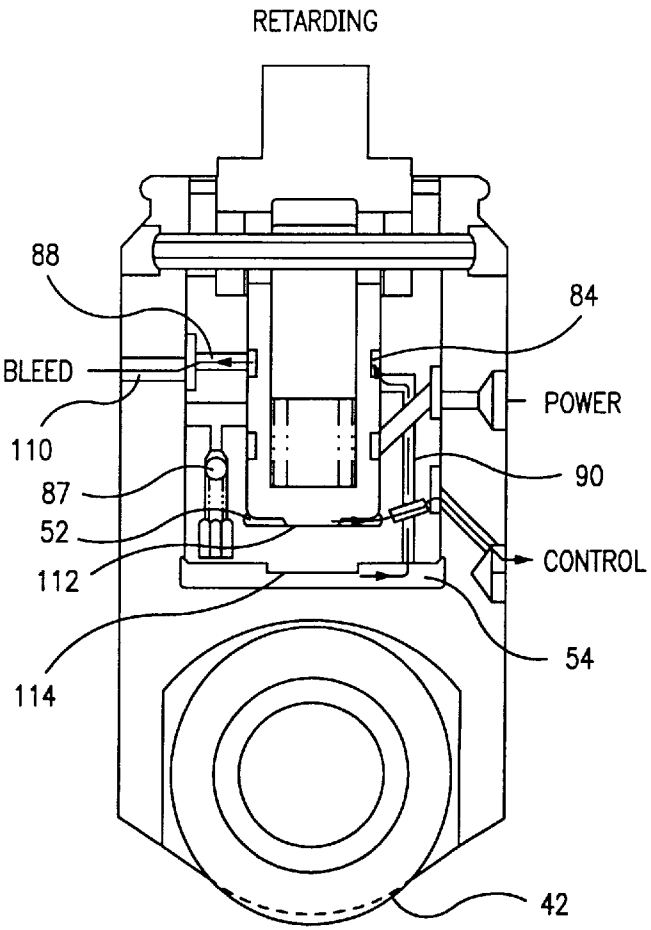
FIGS. 10A and 10B illustrate the fluid flow path during advancing of the advance piston and retarding of the advance piston, respectively, whereby the positions shown in FIGS. 3A–3D can be achieved.
Figure 10A:
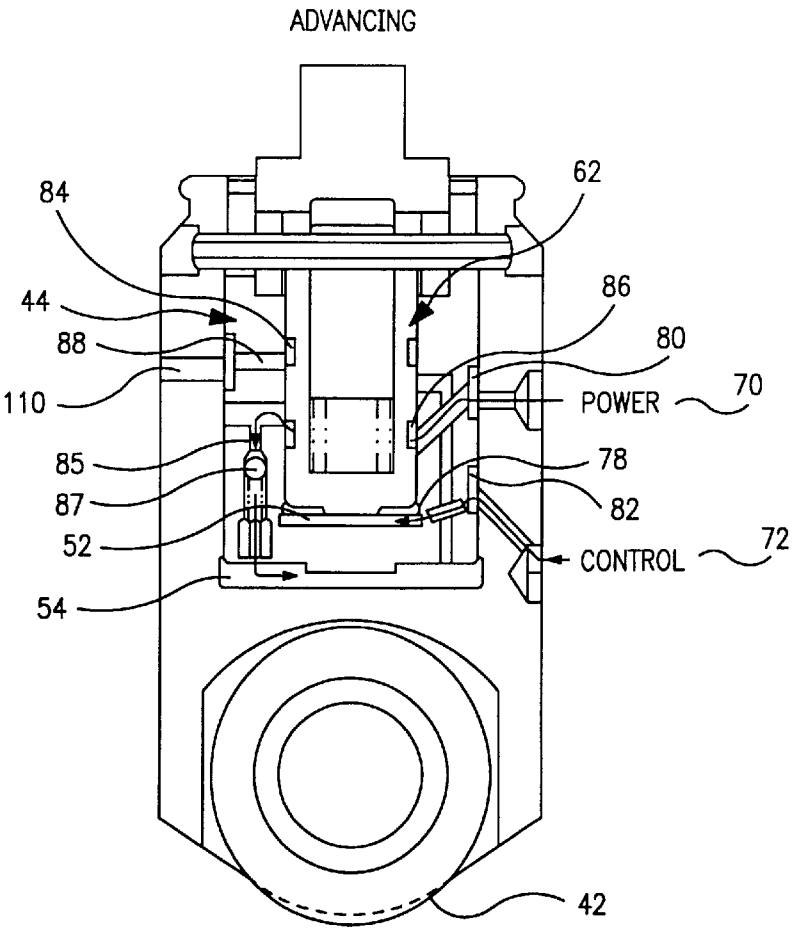

As shown in FIG. 10A, to advance the timing of an injection event, the fluid pressure in hydraulic circuit 63 is increased, thereby increasing the pressure in the servo chamber 52 acting against the force of the servo spring 64. A differential between the force of the servo spring 64 and the servo chamber 52 arises, advancing the servo piston 62 axially upward relative to the advance piston 44. Axial movement of the servo piston 62 upward or away from the advance piston 44 aligns the lower transfer annulus 86 with the feed passage 85 and permits full pressure hydraulic fluid to pass through check valve 87 into the advance chamber 54. The advance chamber 54 expands, forcing the advance piston 44 away from the cam roller 42. Piston cap 60 moves with the advance piston away from the cam roller 42 and acts on the driven end of an injector or pump plunger to advance an injection event produced by the plunger relative to rotation of a cam in contact with the cam roller.

Movement of the advance piston 44 relative to the follower body 46 alters the opposing force relationship between the pressure in the servo chamber 52 and the servo spring 64 by compressing the servo chamber 52 and servo spring 64. The servo piston 62 must move relative to the advance piston to rebalance the opposing forces of the servo chamber 52 and the servo spring 64. This rebalance must occur at predetermined positions, however, due to the interaction of the edges on the ports 80,82,86 and associated passageways. While the advance chamber 54 expands (i.e., advancing) the powering fluid cannot escape the advance chamber, either through the check valve 87 or the bleed passage 90 (which is out of alignment with the upper transfer annulus 84 on the servo piston 62). The servo chamber 52 volume is constricted by upward movement of the advance piston which is opposed by downward force on the servo piston 62 exerted by the servo spring 64.

When the volume of the servo chamber 52 reduces, the excess fluid returns to the control circuit 63, without the need for a separate bleed path. Pressure in the control circuit may be permitted to bleed down by means of a restricted flow opening 120 in communication with, for example, the lubrication oil reservoir (see FIG. 2). A reduced volume servo chamber 52 permits the servo piston to move axially downwardly relative to the advance piston 44. This movement of the servo piston 62 closes fluid communication between the lower transfer annulus 86 and the feed passage 85, which stops the flow of full power hydraulic fluid to the advance chamber 54. Thus, a new stable state is achieved with the advance piston 44 at an advanced position relative to the follower body 46. It will be appreciated that a greater pressure applied to the servo chamber 52 requires greater advancement of the advance piston to restrict the servo chamber 52 to the point that full power hydraulic fluid is cut off from the advance chamber 54. Hence, stepwise increases in hydraulic pressure applied to the servo chamber are translated into discrete advance positions of the advance piston 44 relative to the follower body.

A reverse process is used to retard the advance piston 44 relative to the follower body 46, e.g., move the advance piston closer to the cam roller 42 by reducing the volume of the advance chamber 54. As illustrated in FIG. 10B, when pressure in the servo chamber 52 is reduced from a stable state balance with the force exerted by the servo spring 64, the crown 112 on the base of the servo piston 62 is drawn toward the face of the advance piston bore 43, aligning the bleed passage 90 in the advance piston 44 with the upper transfer annulus 84 in the servo piston 62. It will be noted that this servo piston 62 movement moves the lower fluid transfer annulus 86 away from the feed passage 85 and the upper fluid transfer annulus 84 toward fluid communication with the bleed passages 90, 110 and bleed port 88. Thus, the advance chamber 54 is cut off from a supply of full power hydraulic fluid while the hydraulic fluid in the advance chamber 54 is permitted to flow through the bleed passage 90, upper transfer annulus 84, bleed port 88 and cam follower body bleed passage 110. Since there is no force in opposition, the advance piston 44 is forced toward the cam follower body 46 by the force of the servo spring 64, plunger return spring and any pumping load experienced by the cam follower. When the plunger column is at minimum height (FIG. 3A), the crown 114 on the base of the advance piston 44 is preferably in solid metal-to-metal contact with the face of the bore 48 in the follower body 46. In this elongated position, the force exerted by servo spring 64 on the servo piston 62 is at a minimum and is easily balanced by a low control pressure, e.g., 5 psi. When the servo chamber pressure and servo spring force are balanced, the servo piston returns to its neutral position (FIGS. 3A–3D).

Thus, the advance piston 44 and the servo piston 62 will assume one of the four relationships shown in FIGS. 3A–3D. In each of these balanced states, the servo chamber 52 has the same volume, so the axial position of the servo piston 62 relative to the advance piston 44 is the same (neutral). However, the advance piston 44 (and with it the piston cap) assumes four distinct axial positions relative to the follower body 46, thereby defining four distinct column lengths, and four distinct fuel injection timing options.

It will be apparent to those of skill in the art that, while a preferred embodiment has been described which is capable of achieving four distinct advance positions, the principles of the present invention may be applied to produce more or fewer positions of an advance piston relative to a cam follower. In one respect, a greater number of discrete control pressure levels will produce a corresponding number of advance piston positions.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An actuator having a variable length extending between an energy receiving end and an energy transmitting end, said actuator comprising:

a body defining a first bore;

an actuator piston disposed in said first bore and defining a second bore, said actuator piston movable relative to said body to define a variable volume first hydraulic chamber between said body and said actuator piston; and a servo piston disposed in said second bore and movable relative to said actuator piston to define a second variable volume hydraulic chamber between said actuator piston and said servo piston;

wherein the length of said actuator is dependent upon the volume of said first hydraulic chamber, movement of said servo piston relative to said actuator piston controls delivery of a first hydraulic pressure to said first hydraulic chamber and movement of said servo piston is controlled by delivery of a second hydraulic pressure to said second hydraulic chamber, said second hydraulic pressure being modulated from said first hydraulic pressure.

2. The actuator of claim 1, wherein said second hydraulic pressure is modulated in discrete steps from a maximum hydraulic pressure substantially equal to said first hydraulic pressure to a minimum hydraulic pressure between said maximum hydraulic pressure and zero, each discrete step producing a different actuator length.

3. The actuator of claim 1, wherein a known spring force acts in opposition to movement of said servo piston away from said actuator piston so that a net pressure in said second hydraulic chamber is substantially proportional to the known spring force applied to the servo piston.

4. The actuator of claim 1, further comprising body pressure passageways penetrating said body to communicate with said first bore, said body pressure passageways selectively alignable with actuator piston pressure passageways penetrating said actuator piston to communicate with said second bore, said actuator piston pressure passageways selectively alignable with pressure transfer channels on the outside of said servo piston.

5. The actuator of claim 1, wherein said first and second hydraulic pressures are generated by a single source.

6. The actuator of claim 1, wherein said actuator comprises a cam follower assembly for translating rotary motion of an engine-driven cam into reciprocating linear motion and delivering said reciprocation linear motion to a pumping plunger for a unit pump or injector, said energy receiving end comprising a cam roller supported by said body and said energy transmitting end comprising a piston cap in contact with said first piston and moving relative to said body with said first piston.

7. The actuator of claim 1, wherein said second hydraulic chamber includes a damping orifice which restricts flow of hydraulic fluid into and out of said second hydraulic chamber.

8. A cam follower assembly for translating rotary motion of an engine-driven cam into reciprocating linear motion, said cam follower assembly disposed between the cam and a pumping plunger of a unit pump or injector to apply said reciprocating linear motion to said pumping plunger, said cam follower assembly having a variable length extending from the cam to a plunger actuation surface in contact with said plunger, said cam follower assembly comprising:

a cam follower body defining an advance piston cavity;

an advance piston disposed in said advance piston cavity for axial movement therein, said advance piston defining a servo piston cavity; and a servo piston disposed in said servo piston cavity such that relative movement is permitted between said advance piston and said servo piston, wherein a first hydraulic chamber is defined between said cam follower body and said advance piston and a second hydraulic chamber is defined between said servo piston and said advance piston and the length of said cam follower assembly is dependant upon a volume of said first hydraulic chamber.

9. The cam follower assembly of claim 8, wherein movement of said servo piston relative to said advance piston controls a flow of hydraulic fluid to said first hydraulic chamber and movement of said servo piston is dependent upon a variable hydraulic pressure delivered to said second hydraulic chamber.

10. The cam follower assembly of claim 9, further comprising:

means for mounting one end of a servo piston spring in fixed relation to said follower body, with the other end of said servo piston spring acting on said servo piston in opposition to the hydraulic pressure applied to said second hydraulic chamber such that the net pressure in said second hydraulic chamber is proportional to the force exerted by said servo piston spring.

11. The cam follower assembly of claim 8, wherein said advance piston defines a fluid passage into said second hydraulic chamber and said fluid passage comprises damping means for restricting the flow of hydraulic fluid into and out of said second hydraulic chamber.

12. The cam follower assembly of claim 11, wherein said damping means comprises a restricted flow orifice in said fluid passage.

13. The cam follower assembly of claim 8, wherein a constant hydraulic pressure is applied to said first hydraulic chamber and a modulated hydraulic pressure is applied to said second hydraulic chamber, said constant and modulated hydraulic pressures being derived from a single hydraulic source.

14. The cam follower assembly of claim 8, further comprising:

follower body hydraulic ports and passageways penetrating a cylindrical wall of said follower body surrounding said advance piston cavity;

advance piston hydraulic ports and passageways penetrating a cylindrical wall of said advance piston surrounding said servo piston cavity; and annular fluid transfer channels on an outer surface of said servo piston, wherein said follower body passageways are alignable with said advance piston hydraulic ports and said advance piston passageways are alignable with said annular fluid transfer channels, alignment of said follower body passageways with said advance piston hydraulic ports being dependent upon the position of said advance piston relative to said follower body and alignment of said advance piston passageways with said annular fluid transfer channels being dependent upon the position of said servo piston relative to said advance piston.

15. The cam follower assembly of claim 8, wherein said plunger actuation means comprises:

a piston cap having a lower portion in contact with a shoulder of said advance piston and axially extending to a central projection in contact with said plunger, said piston cap moving in concert with said advance piston such that the reciprocating linear motion of said cam follower assembly is transmitted to said plunger by said advance piston.

16. A method for hydraulically adjusting the timing of an injection event comprising:

axially moving a timing advance piston disposed in a cam follower body relative thereto in response to hydraulic pressure in an advance chamber defined between the cam follower body and the advance piston;

axially moving a servo piston disposed in the timing advance piston relative thereto in response to hydraulic pressure in a servo chamber defined between the advance piston and the servo piston;

applying a substantially constant hydraulic pressure to one of said advance or servo chambers; and applying a modulated hydraulic pressure to the other of said advance or servo chambers, wherein said substantially constant hydraulic pressure and said modulated hydraulic pressure are derived from a single hydraulic pressure source.

17. The method of claim 16, wherein said step of applying a substantially constant hydraulic pressure comprises:

applying said substantially constant hydraulic pressure to said advance chamber; and said step of applying a modulated hydraulic pressure comprises:

applying said modulated hydraulic pressure to said servo chamber, said modulated hydraulic pressure being a stepwise reduced value of said substantially constant hydraulic pressure.

18. The method of claim 16, comprising the step of:

mounting one end of a servo piston spring in fixed relation to the follower body with the other end of the servo piston spring exerting a known force on the servo piston on opposition to the hydraulic pressure in the servo chamber, wherein the pressure in the servo chamber is proportional to the known force exerted on the servo piston by the servo piston spring.

19. The method of claim 16, comprising the step of:

restricting the flow of hydraulic fluid into and out of said servo chamber.

* * * * *